United States Patent [19]

Tee

[11] Patent Number: 4,699,561

[45] Date of Patent: Oct. 13, 1987

[54] ENGINE INTERLOCK CONTROL SYSTEM FOR A MATERIAL HANDLING IMPLEMENT

[75] Inventor: David D. Tee, Houston, Tex.

[73] Assignee: J. I. Case Company, Racine, Wis.

[21] Appl. No.: 860,872

[22] Filed: May 8, 1986

[51] Int. Cl.[4] ..... B66C 23/88; F02B 77/00

[52] U.S. Cl. ..... 414/699; 123/198 DC; 180/273

[58] Field of Search ..... 180/271, 273; 123/198 D, 198 DC; 307/105 B; 414/694, 699, 680, 685; 212/159

[56] References Cited

U.S. PATENT DOCUMENTS

| | | | |
|---|---|---|---|
| 3,993,038 | 11/1976 | Alt et al. | 180/271 X |
| 4,033,311 | 7/1977 | Burson | 180/271 X |
| 4,147,151 | 4/1979 | Wright | 123/198 DC |
| 4,166,442 | 9/1979 | Henderson et al. | 180/271 X |
| 4,236,494 | 12/1980 | Fairchild | 123/198 DC X |
| 4,288,196 | 9/1981 | Sutton, II | 414/699 |
| 4,294,327 | 10/1981 | Howard | 180/273 |
| 4,362,516 | 12/1982 | Lyons | 123/198 D X |
| 4,371,050 | 2/1983 | Ikeura | 180/271 |
| 4,385,863 | 5/1983 | Minor | 414/699 |

*Primary Examiner*—Robert J. Spar
*Assistant Examiner*—Jay I. Alexander
*Attorney, Agent, or Firm*—Dressler, Goldsmith, Shore, Sutker & Milnamow, Ltd.

[57] ABSTRACT

An engine interlock control system is disclosed which is particularly suited for use with a material handling implement comprising a combination loader backhoe. In the preferred form, the present control system includes an electrically-operated fuel solenoid for selectively controlling delivery of fuel to the internal combustion engine of the implement. This system further includes means for sensing operation of the engine, preferably comprising an oil pressure sensor, and means for sensing disposition of the implement's transmission in a neutral condition. The fuel solenoid, engine sensor, and transmission sensor are all operatively connected with a microprocessor control unit, whereby delivery of fuel to the engine is prevented in the event that the engine is not running, and the transmission is in a non-neutral condition. In a preferred embodiment, the present control system further includes means for sensing that the implement is in a condition for backhoe operation, with such sensing means further operatively connected with the microprocessor controls for preventing engine operation when (1) the implement is in a backhoe-operating condition, and (2) the implement transmission is in a non-neutral condition.

5 Claims, 2 Drawing Figures

16
10
14
12
24
20
18

MOVABLE SEAT
24
24
34
SEAT SENSOR
32
MICRO PROCESSOR CONTROLS
25
FUEL SOLENOID
30
NEUTRAL SENSOR
28
OIL PRESSURE SENSOR
ENGINE
TRANSMISSION
DRIVE SHAFT
22
20
26
FUEL TANK

ENGINE INTERLOCK CONTROL SYSTEM FOR A MATERIAL HANDLING IMPLEMENT

TECHNICAL FIELD

The present invention relates generally to a control system for the engine of a material handling implement, and more particularly to an interlock control system for an implement comprising a backhoe which is arranged to prevent jump-starting of the implement when its transmission is in gear, and which further functions to prevent engine operation when the transmission is in gear and the implement is in a backhoe-operating mode.

BACKGROUND OF THE INVENTION

One particularly versatile type of material handling implement is a so-called loader backhoe, which generally comprises a tractor having a hydraulically-operated front-end loader bucket, and a hydraulically-operated rearwardly-mounted backhoe assembly. This type of equipment can perform a wide variety of different material handling operations, including digging, trenching, and like operations.

In order to promote efficient use of the rearwardly-mounted backhoe, this type of implement typically includes an arrangement whereby the operator can sit in a rearwardly-facing direction for backhoe operation, while sitting forwardly for driving the implement, and for operation of the front-end loader. In many such implements, a dual-position movable seat is provided for the operator, such that the same seat can be positioned in either forwardly-facing or rearwardly-facing dispositions. The controls for the implement are suitably positioned for convenient and efficient operation, depending upon the selected position of the operator's seat.

In view of the multi-purpose nature of a loader backhoe, it is desirable to provide a control system which coordinates operation of the implement's different functions, and facilitates convenient operation by precluding certain functions under certain circumstances. For example, it is sometimes necessary to effect "jump-starting" of this type of implement with suitable electrical jumper cables or the like. During such jump-starting, it is desirable that initiation of engine operation only be effected if the transmission of the implement is in a neutral condition, thus precluding inadvertent movement of the implement upon engine starting. Similarly, it is desirable that engine operation be precluded in the event that the implement's transmission is in gear while the implement is in a condition for backhoe operation. This desirably acts to prevent inadvertent movement of the implement if, during backhoe operation, the stabilizers or outriggers of the backhoe are raised.

In view of the above, it is desirable to provide an interlock control system for a material handling implement which, through the use of suitable sensing arrangements and electrical controls, precludes operation of the implement's engine under certain circumstances.

SUMMARY OF THE INVENTION

In accordance with the present invention, an electrical engine interlock control system is disclosed which has been particularly configured to prevent operation of an engine of the implement under certain operational conditions. In particular, the present control system is arranged to prevent starting of the implement engine when the associated transmission driven by the engine is not in a neutral condition. Further, the present control system acts to prevent engine operation in the event that the implement is in a condition for operation of its backhoe, and the transmission of the implement is in gear.

The present engine interlock control system is suited for use with any material handling implement having an internal combustion engine which drives an associated transmission of the implement. In the preferred form, the control system comprises an electrically-operated fuel solenoid which is operatively associated with the internal combustion engine by placement in the fuel delivery system of the implement. Selective operation of the fuel solenoid acts to control the delivery of fuel to the engine, with interruption in fuel delivery of course preventing engine operation.

The present control system further includes an engine-operating sensor operatively associated with the internal combustion engine of the implement for providing an electrical signal reflecting operation of the engine. In the preferred form, the engine sensor comprises an oil pressure sensor which provides an electrical signal reflecting engine oil pressure, and thus engine operation. As will be appreciated, the provision of an oil pressure sensor is common in a material handling implement, and thus this component of the present control system may already be in place on an implement.

The present control system further includes a transmission sensor operatively associated with the implement transmission for providing an electrical signal reflecting disposition of the transmission in a neutral condition. Electrical transmission sensors are well known, and are sometimes arranged to provide a signal to an implement operator that the associated transmission is in neutral, (i.e., not in any gear). In accordance with the present invention, a suitable transmission sensor may alternately provide a signal reflecting disengagement of a clutch within the implement driveline, thus likewise providing a signal that the transmission is in a neutral (i.e., non-driving) condition.

The present interlock control system further includes suitable microprocessor control means which are operatively connected with the fuel solenoid, the engine-operating sensor, and the transmission sensor. In order to prevent starting of the implement engine when the implement's transmission is in gear, the microprocessor controls monitor the signal provided by the engine-operating and transmission sensors. Whenever the controls detect that the engine is not running, and that the associated transmission is in gear, the controls operate the fuel solenoid so as to prevent delivery of fuel to the engine. Thus, if the implement is to be jump-started, such jump-starting can only be effected after the transmission has been placed in a neutral condition.

As noted, the present control system is particularly suited for use with a material handling implement comprising a loader backhoe. To this end, the system includes means for sensing that the implement is in a condition for backhoe operation. In the illustrated embodiment, wherein the implement includes an operator seat movable between a first position for driving the implement, and a second position for operating the backhoe, the backhoe sensing means comprises a sensor which provides an electrical signal indicating disposition of the movable seat in the second, backhoe operating position.

The backhoe sensing means are operatively connected with the microprocessor controls of the system. The controls are suitably programmed such that the fuel solenoid is operated to prevent delivery of fuel to the engine when (1) the backhoe sensor provides an electrical signal indicating operation of the backhoe, (2) and the transmission sensor provides an electrical signal indicating the the transmission is in a non-neutral condition. Thus, the control system functions to prevent engine operation in the event that the implement transmission is in gear and the implement is in the backhoe operating mode.

Other advantages and features of the present invention will become readily apparent from the following detailed description, the accompanying drawings, and the appended claims.

DETAILED DESCRIPTION

Figure 1:
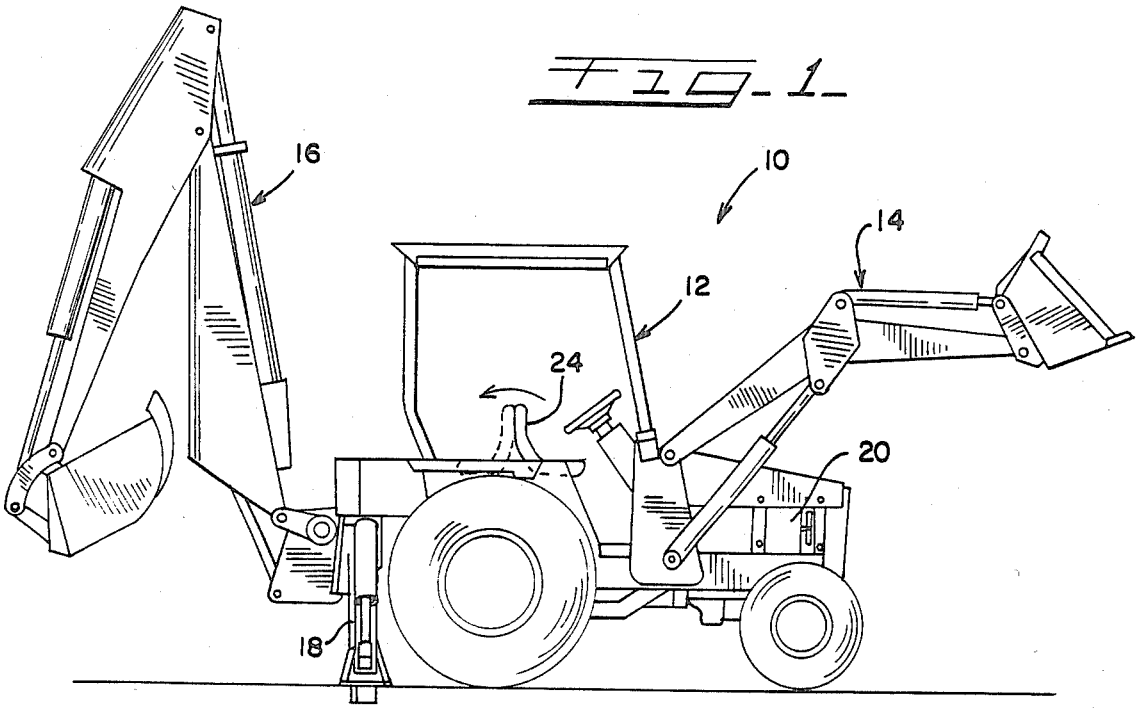
FIG. 1 is a side elevational view of a material handling implement, illustrated as a loader backhoe, for which the present engine interlock control system is suited for use.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIG. 1, therein is illustrated a material handling implement 10, shown as a so-called loader backhoe. As will be recognized by those familiar with the art, this type of implement comprises a wheeled tractor 12 having a hydraulically-operated front-end loader bucket assembly 14 mounted thereon, and a hydraulically-operated backhoe assembly 16 mounted on the rear thereof. Backhoe 16 is illustrated in a typical configuration, including a pair of vertically movable stabilizers 18 (one shown) which are lowered for supporting the implement during backhoe operation.

Figure 2:
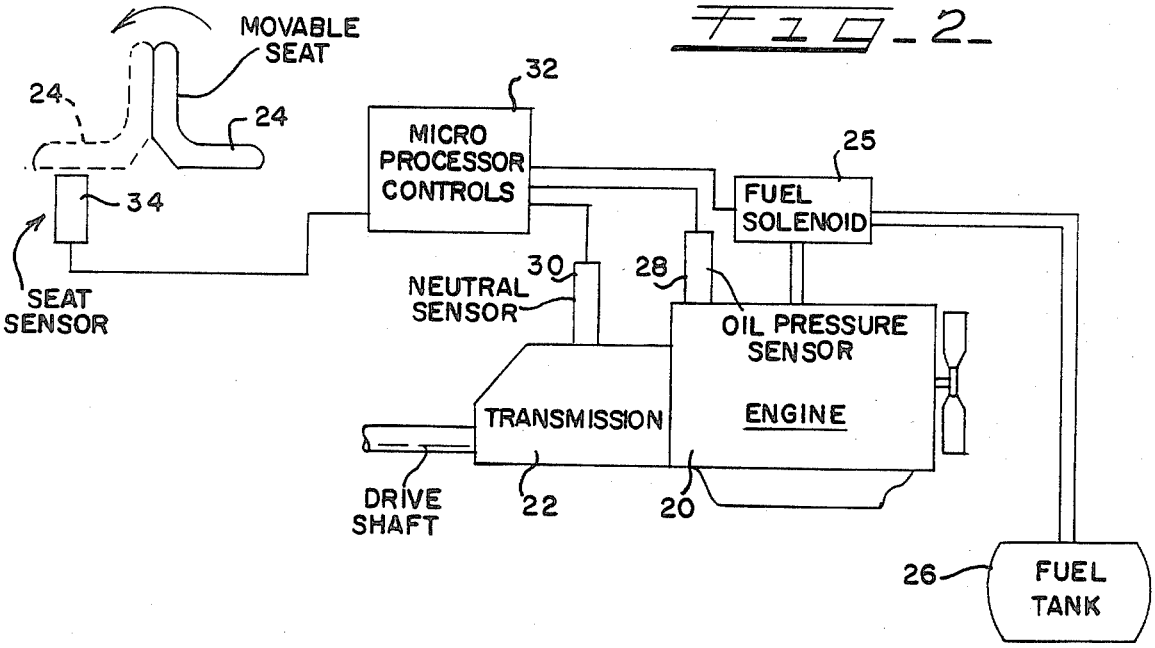
FIG. 2 is a diagrammatic illustration of the present engine interlock control system, and its operative connection with the components of the material handling implement shown in FIG. 1.

Loader backhoe 10 includes a typically forwardly-positioned internal combustion engine 20 which drives tractor 12 through a suitable multi-speed transmission 22 (FIG. 2). Engine 20 is typically operatively connected with one or more hydraulic pumps (not shown) which provide pressurized hydraulic fluid via suitable operator-controlled valves for operation of loader 14 and backhoe 16.

As will be appreciated, the operator of implement 10 ordinarily faces forwardly when driving tractor 12 and when operating loader 14, but ordinarily faces rearwardly during operation of backhoe 16. To this end, the implement includes a movable operator seat 24 in the cab area of the tractor. While the exact seating arrangement of a loader backhoe such as 10 may vary, it is not uncommon to provide a movable seat such as 24 which permits the implement operator to face forwardly for driving the implement, while facing rearwardly, after suitable movement of the seat, for backhoe operation.

In accordance with the present invention, an electrical interlock control system is provided for the loader backhoe 10, and is illustrated diagrammatically in FIG. 2. In the preferred form, the present control system first includes a fuel solenoid 25, which comprises a suitable electrical solenoid-operated fuel valve, the operation of which selectively controls delivery of fuel to engine 20 from an associated fuel tank 26. While the presently preferred form of the present control system is arranged to selectively control delivery of fuel to engine 20 for selective operation of the engine as will be further described; it will be appreciated that in some applications, it can be desirable to effect control of a different engine function, such as control of electrical energy to a spark ignition of the engine. As will be appreciated, the provision of a selectively operable fuel solenoid, in accordance with the preferred form of the present system, permits ready adaptability of the present system to both spark-ignition engines, as well as non-spark-ignition diesel engines.

The present control system further includes an electrical engine sensor operatively associated with the engine 20 for providing an electrical signal reflecting operation of the engine. In the preferred form, the engine operation sensor of the present system comprises an oil pressure sensor 28 operatively associated with the engine 20. An oil pressure sensor 28 typically provides an electrical signal reflecting the presence or lack of oil pressure within the engine, as created by the engine's oil pump. Since many material handling implements include engines having an oil pressure sensor such as 28, it will be appreciated that use of this sensor in the present system facilitates economical installation of the system.

In order to monitor the condition of transmission 22 of the drive line of implement 10, the present system includes a transmission neutral sensor 30 operatively associated with the implement transmission. Neutral sensor 30, which may be of a conventional design, is configured to provide an electrical signal reflecting disposition of transmission 22 in a neutral (i.e., not-in-gear) condition. While an electrical signal reflecting disposition of transmission 22 in a "neutral" (i.e., non-driving) condition may alternately be provided by a suitable electrical sensor indicating disposition of the associated drive line clutch in a disengaged condition, use of a transmission neutral sensor is presently preferred.

Each of the fuel solenoid 25, oil pressure sensor 28, and neutral sensor 30 are operatively connected with suitable microprocessor controls 32 of the present control system. Naturally, advances made in the last several years in the art of electronic controls permits economical use of a suitably-programmed microprocessor in the present control system.

As noted above, the present control system is programmed such that operation of engine 22 is prevented under certain circumstances. In this regard, it is desirable to prevent engine operation in the event that the engine 20 is not running, and the transmission 22 is not in a neutral condition (i.e, is in gear). For example, it is desirable to prevent the engine from starting if the transmission is in gear such as during jump-starting of the implement. Thus, the present control system prevents delivery of fuel to the engine, by operation of fuel solenoid 25, in the event that oil pressure sensor 28 provides a signal that the engine is not running, and neutral sensor 30 provides a signal indicating that the transmission 22 is not in a neutral condition. When the transmission is placed in a neutral condition, and microprocessor controls 32 senses a change in status of the control system, the engine can be started. Upon engine starting, the signal provided to the controls 32 by oil pressure sensor 28 indicates that the engine is operating; under these conditions, operation of transmission 22 from its neutral condition to a non-neutral, engaged condition, has no effect on engine operation. Thus, the implement can be operated normally.

In the preferred form of the present invention, the present engine control system is arranged to prevent operation of engine 22 in the event that loader backhoe 10 is in a condition for operation of its backhoe 16. To this end, the control system includes a sensor for sensing that the implement is in condition for backhoe operation. Such a backhoe operation sensor is operatively connected with microprocessor controls 32, with the controls programmed such that the fuel solenoid 25 is operated to prevent delivery of fuel to the engine 20 when (1) the backhoe sensor provides an electrical signal indicating that the implement is in a condition for backhoe operation, (2) and when transmission sensor 30 provides an electrical signal indicating that the transmission 22 is in a non-neutral condition.

Depending upon the exact configuration of the loader backhoe 10, various types of sensing means may be employed for providing a suitable signal indicating that the implement is in a backhoe-operating condition. In the illustrated embodiment, the backhoe sensing means is provided in the form of a seat-position sensor 34 operatively associated with the movable seat 24 of the implement. As diagrammatically shown in FIG. 2, seat sensor 34, which may comprise a suitable microswitch or the like, is arranged to provide a suitable electrical signal attendant to movement of seat 24 from a first, forwardly-facing position for driving the implement, to a second, rearwardly-facing position for operating backhoe 16.

Thus, in the event that movable seat 24 is in its second, backhoe-operating position, seat sensor 34 provides an electrical signal to microprocessor controls 32 indicating this condition of the implement. In the event that transmission 22 is in a non-neutral condition, as sensed by neutral sensor 30, fuel solenoid 24 is operated to prevent delivery of fuel to engine 20, thus preventing operation of the engine. This aspect to the present control system desirably prevents inadvertent movement of the implement such as when backhoe 16 is being operated, and stabilizers 18 are raised, thus lowering the driving wheels of tractor 12.

From the foregoing, it will be observed that numerous modifications and variations of the present control system can be effected without departing from the true spirit and scope of the novel concept of the present invention. It will be appreciated that no limitation with respect to the specific embodiment disclosed herein are intended or should be inferred. The disclosure is intended to cover by the appended claims all such modifications as fall within the scope of the claims.

What is claimed is:

1. An engine interlock control system for a material handling implement having an internal combustion engine which drives a transmission, wherein said material handling implement comprises a backhoe, said control system comprising:

electrically-operated fuel solenoid means operatively associated with said internal combustion engine whereby operation of said solenoid means controls the delivery of fuel to said engine;

engine sensor means operatively associated with said implement engine for providing an electrical signal reflecting operation of said engine;

transmission sensor means operatively associated with said implement transmission for providing an electrical signal reflecting a non-neutral condition of said transmission;

control means operatively connected with said fuel solenoid means, said engine sensor means, and said transmission sensor means, said control means operating said solenoid means to prevent delivery of fuel to said engine when said engine sensor means provides a signal that said engine is not operating, and said transmission sensor means provides a signal that said transmission is not in the neutral condition; and backhoe sensing means for sensing that said implement is in a condition for operation of said backhoe, said backhoe sensing means being operatively connected with said control means, said control means operating said fuel solenoid means to prevent delivery of fuel to said engine when (1) said backhoe sensor means provides an electrical signal indicating said implement is in a condition for operation of said backhoe, and (2) said transmission sensor means provides an electrical signal indicating that said transmission is in a non-neutral condition.

2. An interlock control system in accordance with claim 1, wherein said implement comprising said backhoe includes a movable operator seat movable between a first position for driving said implement, and a second position for operating said backhoe, said backhoe sensing means comprising means for sensing disposition of said movable seat in said second, backhoe operating position.

3. An interlock control system in accordance with claim 1, wherein said engine sensor means comprises an oil pressure sensor for monitoring the oil pressure of said engine.

4. An engine interlock control system for a material handling implement having an internal combustion engine which drives a transmission, wherein said material handling implement comprises a backhoe, said control system comprising:

engine operating means operatively associated with said internal combustion engine for controlling operation of said engine;

engine sensor means operatively associated with said implement engine for providing an electrical signal reflecting operation of said engine;

transmission sensor means operatively associated with said implement transmission for providing an electrical signal reflecting a non-neutral condition of said transmission;

control means operatively connected with said engine operating means, said engine sensor means, and said transmission sensor means, said control means operating said engine operating means to prevent operation of said engine when said engine sensor means provides a signal that said engine is not operating, and said transmission sensor means provides a signal that said transmission is not in the neutral condition; and backhoe sensing means for sensing that said implement is in a condition for operation of said backhoe, said backhoe sensing means being operatively connected with said control means, said control means operating said engine operating means to prevent operation of said engine when (1) said backhoe sensor means provides an electrical signal indicating said implement is in a condition for operation of said backhoe, and (2) said transmission sensor means provides an electrical signal indication that said transmission is in a non-neutral condition.

5. An interlock control system in accordance with claim 4, wherein said implement comprising said backhoe includes a movable operator seat movable between a first position for driving said implement, and a second position for operating said backhoe, said backhoe sensing means comprising means for sensing disposition of said movable seat in said second, backhoe operating position.

* * * * *